United States Patent [19]

Klekamp et al.

[11] 4,343,101

[45] Aug. 10, 1982

[54] SCRAPER BOWL STRUCTURE

[75] Inventors: William H. Klekamp, Decatur; Philip H. Tullis, Taylorville, both of Ill.

[73] Assignee: Caterpillar Tractor Co., Peoria, Ill.

[21] Appl. No.: 250,747

[22] PCT Filed: Sep. 12, 1980

[86] PCT No.: PCT/US80/01196

§ 371 Date: Sep. 12, 1980

§ 102(e) Date: Sep. 12, 1980

[87] PCT Pub. No.: WO82/01021

PCT Pub. Date: Apr. 1, 1982

[51] Int. Cl.[3] ..... E02F 3/64

[52] U.S. Cl. ..... 37/129; 37/126 AA

[58] Field of Search ..... 37/8, 124, 126 R, 126 A, 37/126 AA, 126 AB, 126 AC, 126 AD, 126 AE, 129, 133

[56] References Cited

U.S. PATENT DOCUMENTS

| | | | |
|---|---|---|---|
| 2,078,500 | 4/1937 | Maloon | 37/126 AC |
| 2,321,410 | 6/1943 | Mork et al. | 37/126 AB |
| 2,567,534 | 9/1951 | Whittier | 37/126 R |
| 2,609,622 | 9/1952 | Murray | 37/126 AB |
| 2,858,627 | 11/1958 | Brown et al. | 37/126 R |
| 3,406,470 | 10/1968 | Fall et al. | 37/126 R |
| 3,541,709 | 11/1970 | Comer, Jr. | 37/126 R |

FOREIGN PATENT DOCUMENTS

| | | | |
|---|---|---|---|
| 480544 | 2/1938 | United Kingdom | 37/129 |

*Primary Examiner*—E. H. Eickholt

*Attorney, Agent, or Firm*—Wegner, Stellman, McCord, Wiles & Wood

[57] ABSTRACT

A scraper bowl structure (11) for use in a scraper vehicle (10) having a rear wheeled support (12) and a wheeled tractive unit (15). The bowl structure (11) is defined by sidewalls (16,17) pivotally mounting a front apron (22) and a rear blade (25). Positioning devices (29,30) are associated with the apron (22) and blade (25), respectively, selectively positioning the apron (22) and blade (25) in raised and lowered positions. Spreader elements (19,20,21) for securing the sidewalls in spaced relationship further serve as supporting elements for supporting the blade (25) in the different dispositions thereof. The configuration of blade (25) is preselected so as to bulldoze earth forwardly onto the apron (22) in a lowered position of the blade (25) and apron (22).

10 Claims, 3 Drawing Figures

SCRAPER BOWL STRUCTURE

TECHNICAL FIELD

This invention relates to earthmoving scrapers and the like wherein earth is scraped into a bowl for transport to a disposal site.

BACKGROUND ART

Conventional scraper bowl structures typically include a pair of sidewalls, a forwardly extending bowl floor, a rear ejector, and a front apron. In operation, the entire bowl structure, including the sidewalls, is pivoted around the supporting rear wheels from a raised load-carrying position to a lowered loading position. In the loading position, the front edge of the rigid bowl floor scrapes earth into the rear portion of the scraper bowl structure until the desired load is obtained, whereupon the apron is pivotally lowered to close the bowl structure and the entire bowl structure pivotally raised to the load-carrying position. Upon reaching the desired site, the bowl structure is pivotally lowered, the apron raised, and the ejector urged forwardly to displace material from the rear of the bowl structure.

While the aforementioned scraper bowl structure has been widely accepted, it is relatively complex and costly in construction. In addition to requiring movement of the ejector and apron, the entire bowl structure must be pivotally raised and lowered, and this leads to complex supporting systems at the front end thereof. For example, pairs of undesirable draft arms extend around the sidewalls of the bowl structure so that the bowl structure can be pivotally raised and lowered, and expensive hydraulic jacks are required to perform this function.

Another problem with conventional scraper bowl structures is that, in the loading mode, earth enters over the cutting edge of the bowl floor and soon accumulates such that earth is forced upwardly against earth. This frictional retardation requires more loading energy and is time-consuming.

U.S. Pat. No. 2,567,534 to C. Whittier on Sept. 11, 1951, discloses one bowl structure having a rear blade that advantageously loads onto a front apron. However, the rear blade is rigidly secured to the supporting frame so that it is necessary to pivotally raise and lower the bowl supporting frame. This requires an undesirably complex and costly construction.

U.S. Pat. No. 2,858,627 to A. J. Brown et al on Nov. 4, 1958, discloses another bowl structure desirably having only a movable front apron bowl and a movable rear main loading bowl. But, the support therefor must also be raised and lowered, and earth soon accumulates at the front edge of the rear bowl during loading until the entire mass must be forced upwardly and rearwardly in much the same way as a more conventional bowl structure.

Accordingly, what is desired is a scraper bowl structure which does not have to be raised and lowered as a unit, which has a relatively few number of pivotal components, and which can be relatively easily loaded and unloaded for effective economy of operation and the saving of energy.

DISCLOSURE OF INVENTION

The present invention comprehends an improved scraper bowl structure wherein the apron and blade are pivotally mounted between horizontally spaced fixed sidewalls and are selectively positionable in a scraping arrangement, a load-carrying arrangement, and a load-discharging arrangement.

The scraper bowl structure of the present invention is extremely simple and economical of construction while providing effectively minimum structural weight requirements so as to permit increased payload of the scraper vehicle and/or permit reduction in the horsepower requirements of the tractive unit.

More specifically, the invention comprehends the provision of an improved blade structure for use in a scraper bowl structure of the type having a pair of upright sidewalls, frame means for supporting and maintaining the sidewalls in a substantially fixed elevational relationship to the earth, and a concave apron pivotally connected to the sidewalls and being movable between raised and lowered positions therebetween. The blade structure is defined by a concave blade pivotally connected to the frame means and being movable between raised and lowered positions between the sidewalls, the blade being of a construction sufficient for bulldozing earth forwardly onto the apron in the lowered position of the blade and apron.

A number of spreader members may be provided extending between the spaced sidewalls which may cooperate with the apron and blade in supporting the same in different positions thereof.

In the illustrated embodiment, a push frame is provided at the rear of the bowl structure, the blade being pivotally mounted to the push frame.

The second positioning means is arranged to dispose the blade in the scraping disposition with the apron being disposed in the retracted disposition.

In the illustrated embodiment, the apron and blade are generally segmentally cylindrical so as to cooperatively define, with the sidewalls, a generally semicylindrical, upwardly open load space when the apron and blade are disposed in the load-carrying disposition.

In the illustrated embodiment, the cutting edge engages a rear edge portion of the apron when the apron and blade are concurrently disposed in the load-carrying disposition.

The sidewalls are arranged to extend generally horizontally at all times.

In the illustrated embodiment, a substantial portion of the apron is disposed above the level of the top of the sidewalls when the apron is disposed in the retracted disposition.

Thus, the scraper bowl structure of the present invention is extremely simple and economical of construction comprising essentially a pair of spaced sidewalls, a first movable bowl-forming member in the form of an apron, and a second bowl-forming member in the form of a blade. The bowl-forming elements are arranged in a novel manner to provide selectively the desired scraping, load-carrying and load discharging functions desired in such scraper structures.

BEST MODE FOR CARRYING OUT THE INVENTION

Figure 1:
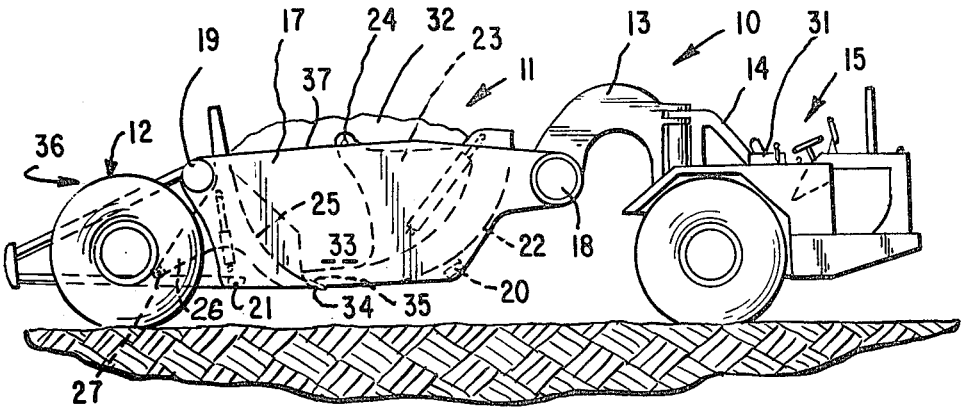
FIG. 1 is a side elevation of a scraper vehicle embodying the invention.

In the illustrated embodiment of the invention as disclosed in the drawing, a scraper vehicle generally designated 10 is shown to include a scraper bowl structure generally designated 11 supported rearwardly on a wheeled support generally designated 12 and forwardly on a gooseneck 13 connected through a hitch 14 to a wheeled tractive apparatus generally designated 15.

The present invention is concerned with the construction of the scraper bowl structure 11. More specifically, the bowl structure includes a pair of sidewalls 16 and 17 which are secured in spaced-apart relationship by a front spreader tube 18, a rear spreader tube 19, a front spreader bar 20, and a rear spreader bar 21.

A front apron 22 is pivotally mounted by means of arms 23 to the sidewalls 16 and 17 by suitable pivots 24.

A rear blade 25 is pivotally mounted between the sidewalls 16 and 17 by means of a pair of arms 26 pivotally connected to pivots 27 on a rear push frame 28 of the wheeled support 12. Thus, the illustrated embodiment, the vehicle front and rear frame means generally designated 36 includes support 12, gooseneck 13, hitch 14, tractive apparatus 15, tube 18, tube 19, bar 20, bar 21, and rear frame 28.

A pair of hydraulic cylinders 29, disposed outboard of sidewalls 16 and 17 at opposite sides of the scraper, are connected to the front apron 22 for swinging the apron selectively about pivots 24. A pair of hydraulic cylinders 30 are connected between sidewalls 16 and 17 and the rear blade 25 for swinging the blade selectively about pivots 27.

Suitable controls 31 are provided in the tractive unit 15 for selectively operating the hydraulic cylinders, as further discussed below.

As shown in FIG. 1, apron 22 and blade 25 may be cooperatively arranged in a load-carrying disposition to support the scraped material 32 as for transfer of the material 32 to a delivery site from the loading site. In the load-carrying disposition, the upwardly opening concave apron 22 and upwardly facing concave blade 25 cooperatively define, with the sidewalls 16 and 17, a generally semicylindrical, upwardly opening load space 33. As shown in FIG. 1, apron 22 is generally segmentally cylindrical.

Blade 25 may be provided with a cutting edge portion 34 which is juxtaposed to the rear edge portion 35 of the apron 22 in the load-carrying disposition. More specifically, the cutting edge 34 may be abutted with the rear edge portion 35 of apron 22 to effectively close the bottom of the load-carrying space 33 and thereby effectively retain the scraped material 32 in the bowl 11 during the load-carrying operations.

Figure 2:
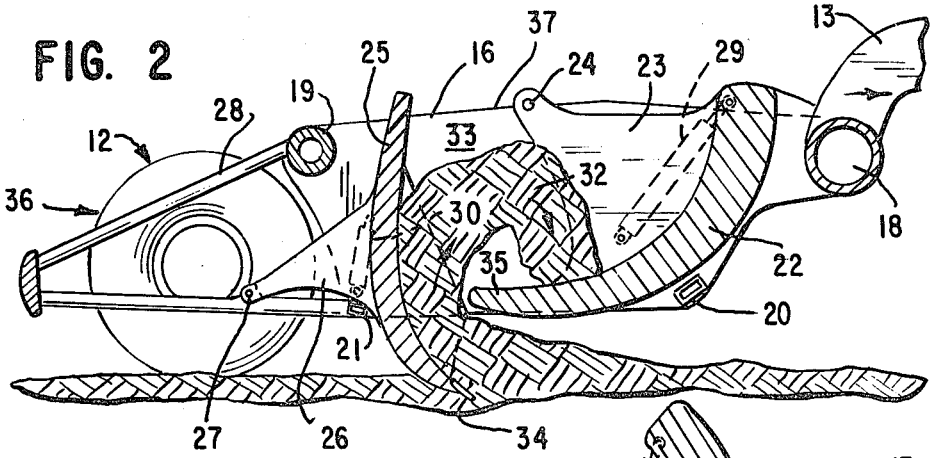
FIG. 2 is a fragmentary enlarged side elevation partially in section illustrating the arrangement of the structure as during a scraping operation.

In the scraping operation, blade 25 is pivoted downwardly by the hydraulic cylinders 30 to bring the cutting edge 34 to the subjacent earth to be scraped. As shown in FIG. 2, apron 22 is retained in the same position as in the load-carrying arrangement of FIG. 1, and thus, continues to define the front wall and front portion of the bottom wall of the load space 33. As illustrated in FIG. 2, the segmentally cylindrical configuration of blade 25 causes the scraped material 32 to move upwardly therealong and roll forwardly onto the apron 22 during the scraping operation. Thus, the transfer of material into the bowl is effectively unimpeded by the previously collected material as it is deposited in the bowl forwardly of the blade. As shown in FIG. 2, in the scraping position, arms 26 of the blade may engage the rear spreader bar 21 in one position.

When a full load of material is scraped into the bowl space 33, hydraulic cylinders 30 are extended so as to pivot blade 25 in a counterclockwise direction about pivots 27 from the scraping position of FIG. 2 to the load-carrying position of FIG. 1 wherein the cutting edge 34 engages the rear portion 35 of apron 22. Thus, the blade and apron cooperate to define the front, rear and closed bottom walls of the bowl intermediate the fixed horizontally spaced sidewalls 16 and 17, permitting the load to be transported as desired by the vehicle 10.

Figure 3:
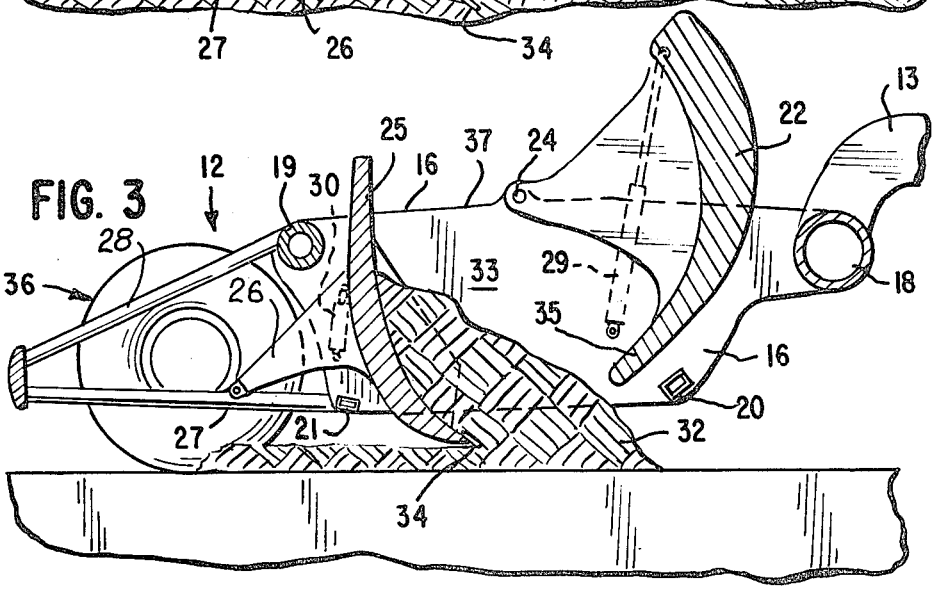
FIG. 3 is a view similar to that of FIG. 2 but with the elements of the bowl structure arranged as during a load-discharging operation.

Referring now to FIG. 3, to dump the collected material 32 from the bowl, apron 22 is pivoted in a counterclockwise direction about pivots 24 by the hydraulic cylinder 29 to a retracted disposition wherein the apron extends to a considerable extent above the upper level of the sidewalls 16 and 17. In the retracted disposition, the rear portion 35 of apron 22 is removed from under the load space 33, permitting the collected material 32 to discharge downwardly from space 33, as desired.

As further shown in FIG. 3, during the dumping operation, blade 25 may be pivoted in a clockwise direction by hydraulic cylinders 30 to a lowered disposition, further opening the bottom of the load space 33 and permitting the blade to be utilized in leveling the dumped material 32, as desired.

In the illustrated embodiment, apron pivots 24 are disposed at the upper edge 37 of sidewalls 16 and 17.

INDUSTRIAL APPLICABILITY

Thus, the scraper vehicle 10 provides an improved low cost earthworking apparatus wherein the scraper bowl 11 is defined by a pair of fixed, horizontally spaced sidewalls 16 and 17, a movable front apron 22, and a movable rear blade 25. Positioning means in the form of hydraulic cylinders 29 and 30 are associated with the apron and blade respectively to provide selective positioning thereof in a scraping arrangement, a load-carrying arrangement, and a dumping arrangement. The apron and blade illustratively are segmentally cylindrical so as to define a semi-cylindrical load space with the blade guiding the scraped material into a roll-over path depositing it on the rear portion of the apron and thereby effectively minimizing power requirements in the scraping operation.

Scraper bowl structure 11 provides for automatic loading of the scraped material onto the apron by causing the material to clear itself from the blade in falling forwardly therefrom in a roll-over action onto the lower portion of the apron.

Thus, the scraper bowl structure of the present invention is advantageously adapted for use in a wide range of scraper vehicles, such as used in earthmoving operations. By virtue of the reduced weight of the novel scraper bowl structure and the facilitated roll-over loading of the scraped material therein, the structure is adapted for use with tractive units of reduced horsepower and, thus, provides improved energy usage efficiency.

Further, as the scraper bowl effectively does not move upwardly or downwardly, but rather only the front and rear walls are repositioned in the different arrangements of the structure, conventional draft arm and spreader structures are eliminated, thereby further reducing the structural weight and providing improved energy usage efficiency.

Still further, as the scraper bowl does not move up or down in use, there is no pitching motion of the tractor when the scraper loading mechanism is selectively lowered and raised. Thus, an improved match of the push-pull components on the tractor front portion and the scraper rear portion is provided.

The bowl structure utilizes the bowl spreader element for improved support of the blade in the different selected dispositions thereof. Thus, as discussed above, the invention provides high strength in the bowl structure in use while yet effectively minimizes the number of structural elements and, thus, the overall weight of the apparatus, thereby providing further improved energy usage efficiency.

Other aspects, objects and advantages of this invention can be obtained from a study of the drawings, the disclosure and the appended claims. The foregoing disclosure of specific embodiments is illustrative of the broad inventive concepts comprehended by the invention.

We claim:

1. In a scraper bowl structure (11) of the type having a pair of upright sidewalls (16,17), frame means (36) for supporting and maintaining the sidewalls (16,17) in a substantially fixed elevational relationship to the earth, and a concave apron (22,23) pivotally connected to the sidewalls (16,17) and being swingable between raised and lowered positions therebetween, the improvement comprising a concave blade (25,26) pivotally connected to the frame means (36) and being swingable between raised and lowered positions between the sidewalls, the blade (25,26) being of a construction sufficient for bulldozing earth forwardly onto the apron (22,23) in the lowered position of the blade (25,26) and apron (22,23), said apron defining a lower rear edge and said blade defining a lower front edge, said edges extending generally horizontally and overlapping in the lowered position of the apron and blade, and said blade including a sideless bulldozer blade portion (25) and a pair of rearwardly extending arms (26), the arms being pivotally connected to the frame means (36).

2. The scraper bowl structure (11) of claim 1 wherein the frame means (36) includes a front spreader member (20) extending under the apron (22,23).

3. In a scraper bowl structure (11) of the type having a pair of upright sidewalls (16,17), frame means (36) for supporting and maintaining the sidewalls (16,17) in a substantially fixed elevational relationship to the earth, and a concave apron (22,23) pivotally connected to the sidewalls (16,17) and being movable between raised and lowered positions therebetween, the improvement comprising a concave blade (25,26) pivotally connected to the frame means (36) and being movable between raised and lowered positions between the sidewalls, the blade (25,26) being of a construction sufficient for bulldozing earth forwardly onto the apron (22,23) in the lowered position of the blade (25,26) and apron (22,23), said blade (25,26) including a sideless bulldozer blade portion (25) and a pair of rearwardly extending arms (26), the arms (26) being pivotally connected to the frame means (36).

4. The scraper bowl structure (11) of claim 3 wherein the frame means (36) includes a rear push frame (28) and the blade (25,26) is pivotally connected to the rear push frame (28).

5. In a scraper bowl structure (11) of the type having a pair of upright sidewalls (16,17), frame means (36) for supporting and maintaining the sidewalls (16,17) in a substantially fixed elevational relationship to the earth, and a concave apron (22,23) pivotally connected to the sidewalls (16,17) and being movable between raised and lowered positions therebetween, the improvement comprising a concave blade (25,26) pivotally connected to the frame means (36) and being movable between raised and lowered positions between the sidewalls, the blade (25,26) being of a construction sufficient for bulldozing earth forwardly onto the apron (22,23) in the lowered position of the blade (25,26) and apron (22,23), said apron (22,23) having a rear edge portion (35) and the blade (25,26) having a cutting edge (34), the rear edge portion (35) and the cutting edge (34) being in contact at the lowered position of the apron (22,23) and the raised position of the blade (25,26).

6. The scraper bowl structure (11) of claim 5 wherein the frame means (36) includes a rear spreader member (21) extending under and supporting the blade (25,26) in the lowered position of the blade (25,26).

7. In a scraper bowl structure (11) of the type having a pair of upright sidewalls (16,17), frame means (36) for supporting and maintaining the sidewalls (16,17) in a substantially fixed elevational relationship to the earth, and a concave apron (22,23) pivotally connected to the sidewalls (16,17) and being movable between raised and lowered positions therebetween, the improvement comprising a concave blade (25,26) pivotally connected to the frame means (36) and being movable between raised and lowered positions between the sidewalls, the blade (25,26) being of a construction sufficient for bulldozing earth forwardly onto the apron (22,23) in the lowered position of the blade (25,26) and apron (22,23), said apron (22,23) having a rear edge portion (35) and the blade (25,26) having a cutting edge (34), the rear edge portion (35) and the cutting edge (34) being in contact at the lowered position of the apron (22,23) and the raised position of the blade (25,26), said frame means (36) including a spreader (19) extending rearwardly of and supporting the blade (25) in said load-carrying disposition.

8. The scraper bowl structure (11) of claim 7 wherein each of the sidewalls (16,17) has an upper edge (37), and the apron (22,23) is pivotally connected to the sidewall adjacent said upper edge (37).

9. The scraper bowl structure (11) of claim 7 wherein said sidewlls (16,17) are arranged to extend generally horizontally in each of the scraping, load-carrying, and load-discharging dispositions of the apron (22) and blade (25).

10. The scraper bowl structure (11) of claim 7 wherein a substantial portion of the apron (22) is disposed above the level of the top of said sidewalls (16,17) in the retracted disposition of the apron (22).

* * * * *